United States Patent [19]

Wallace

[11] Patent Number: 4,526,682

[45] Date of Patent: Jul. 2, 1985

[54] SCREEN ASSEMBLY FOR SEPARATING PARTICULATE MATERIAL

[75] Inventor: William H. Wallace, Bluffton, Ind.

[73] Assignee: Ferrell-Ross, Inc., Bluffton, Ind.

[21] Appl. No.: 558,505

[22] Filed: Dec. 6, 1983

[51] Int. Cl.[3] ..... B07B 1/50

[52] U.S. Cl. ..... 209/337; 209/381; 209/399; 210/353

[58] Field of Search ..... 209/309, 323, 379, 381, 209/382, 337, 342, 379, 395, 399, 403, 405, 392, 398, 402, 404; 55/293, 300; 210/353

[56] References Cited

U.S. PATENT DOCUMENTS

| | | | |
|---|---|---|---|
| 218,530 | 8/1879 | Holcomb et al. | 209/382 |
| 1,265,267 | 5/1918 | Simpson | 209/332 |
| 1,441,812 | 1/1923 | Landrichinger | 209/29 |
| 1,562,311 | 11/1925 | Dimm | 209/382 |
| 2,165,946 | 7/1939 | Smith | 83/94 |
| 2,226,416 | 12/1940 | Simpson et al. | 209/382 |
| 2,269,289 | 1/1942 | Schifflin et al. | 209/323 |
| 2,296,293 | 9/1942 | Nacher | 209/382 |
| 2,332,780 | 10/1943 | Cecka | 209/323 |
| 2,395,138 | 2/1946 | Nicholls | 209/323 |
| 2,497,902 | 2/1950 | Moyer | 209/381 |
| 2,829,772 | 4/1958 | Landes et al. | 209/323 |
| 2,858,023 | 10/1958 | Holland | 209/381 |
| 2,946,440 | 7/1960 | Simpson | 209/323 |
| 3,565,251 | 2/1971 | Pennington | 209/323 |
| 4,122,006 | 10/1978 | Christensen et al. | 209/382 |
| 4,152,253 | 5/1979 | Summers | 209/323 |
| 4,237,000 | 12/1980 | Read et al. | 209/395 |

OTHER PUBLICATIONS

Advertising brochure–Carter–Day's Advanced Design in Seed/Grain Cleaning, Bullentin SM3–82, Mar. 1982.

Advertising brochure–Carter–Day's Screen Machine, Bullentin B 3M 4/83, Apr. 1983.

*Primary Examiner*—Richard V. Fisher

*Assistant Examiner*—Wanda L. Millard

*Attorney, Agent, or Firm*—Dann, Dorfman, Herrell and Skillman

[57] ABSTRACT

In an apparatus for separating particulate material of a selected size from particulate material of a smaller size, there is provided a screen assembly having a screen element for separating the particulate material. A tray assembly loosely supports impact elements in close relationship to the screen to dislodge particulate material from the apertures of the screen upon impact during operation of the apparatus which agitates the screen and tray assembly. The screen element and the tray assembly form an enclosure for the impact elements. The screen assembly and tray assembly are intermeshed and independently supported from one another and are adapted to separate upon removal from the apparatus.

18 Claims, 3 Drawing Figures

SCREEN ASSEMBLY FOR SEPARATING PARTICULATE MATERIAL

FIELD OF THE INVENTION

The present invention relates to a screen assembly for use in an apparatus for separating particulate material of a selected size from particulate material of a smaller size and, more particularly, to a screen assembly for use in an apparatus for separating dust, dirt and other debris from a desired particulate material, such as commodity seed, or other desired product susceptible to separation by screening.

BACKGROUND OF THE INVENTION

In the farm industry, seed cleaners are utilized to separate dust, dirt, weed seeds, and other fine debris from the desired commodity seed. For this purpose, a seed sifting or screening mechanism is employed. The screening mechanism typically provides a screen along an inclined plane which is agitated in a generally gyratory or oscillatory path. The particulate material to be cleaned is introduced onto the upper surface of the screen and vibration causes the particulate material to be conveyed along the screen surface. The movement of the particulate material along the screen causes the fines, such as the dust or other waste material, to be discharged through the apertures of the screen while the overs, such as the commodity seed, is collected at the end of the screening surface for further treatment or removal from the apparatus.

One of the problems associated with using a vibrating screen to separate particulate material is that the apertures of the screen often become clogged with particulate matter thereby reducing the efficiency of the cleaning operation. To dislodge material from the screen apertures, various cleaning mechanisms have been employed. For example, brush assemblies have been employed in which motor driven brushes are swept along the under surface of the screens to dislodge the particles from the screen apertures. However, the drive mechanism operating the brushes is subject to wear and breakage. Further routine servicing is required to maintain the normal operation of the drive mechanism. In addition, periodic replacement and cleaning of the brushes is also required.

To obviate these difficulties, cleaning of the screen apertures has been effected through the use of screen impacting balls loosely supported underneath the screen in a container which is affixed or attached to the screening surface. The impacting balls are simultaneously agitated with the screen assembly. Through continual impact with the screen, the impacting balls function to loosen and dislodge debris from the apertures of the screen.

To efficiently process various types of seeds or other particulate material through the separating apparatus, screens employing different sized apertures are required to enable the user to efficiently match a particular screen with the particulate material being processed. If the container for the impacting balls is attached or affixed to the screen, screen replacement to accommodate a different type of particulate material becomes difficult and time consuming. Either a separate ball tray container must be provided with each screen, or the ball tray container must be detached from the original screen by removing the container fasteners and then reattaching the container to the selected replacement screen. This change over procedure is cumbersome and inefficient. If the screens are not frequently changed, the fasteners are often difficult to remove due to rusting or various other factors. In addition, conventional fasteners can be easily lost or misplaced in a farm environment.

The efficiency of operation of a conventional seed cleaning and separating apparatus employing a brush-type cleaner may be increased by retrofitting the brush mechanism with a ball tray container having impact balls, thereby eliminating the brush mechanisms that is subject to servicing or breakage. However, if the ball tray containers for the impact balls are conventionally attached or affixed to the individual cleaning screens, such an arrangement is not desirable, as previously noted, due to the inherent inefficiencies when changing the screens to accommodate different types of particulate material.

SUMMARY OF THE INVENTION

In accordance with the present invention, a screening assembly is provided in an apparatus for separating particulate material of selected size from particulate material of a smaller size. The screening assembly is readily adaptable for retrofitting an existing cleaning apparatus, while providing a tray assembly for screen impact elements that is efficiently interchangeable with different cleaning screens. The screening assembly comprises screen means having apertures of a selected size for receiving and separating the particulate material by permitting the fines contained within the particulate material to pass through the screen apertures, while retaining the overs on the screen surface. The impact elements, such as balls, are provided for impacting the screen means to dislodge particulate material from the screen apertures. The tray assembly loosely supports the impact elements underneath the screen means and provides a support platform for the impact elements. The support platform is intermeshable with the screen means to form an enclosure for the impact elements.

Agitator means is provided for agitating and vibrating the enclosure formed by the screen means and the support platform. The agitating movement of the apparatus impacts the screen means with the impact balls and conveys the particulate material along the screen means to separate the particulate material of the smaller size through the apertures in the screen means. First guide means is provided on the agitator means for receiving and supporting the screen means. Second guide means is provided on the agitator means, generally beneath the first guide means, for independently receiving and supporting the support platform under the screen means. The second guide means functions to retain the support platform in position underneath the screen means in a detached intermeshed relationship with the screen means. Since the screen means is not attached or affixed to the support platform, the second guide means provides the necessary support for the support platform, while the intermeshing of the support platform with the screen means retains the support platform and the screen means in registry with one another during operation of the apparatus. When the intermeshed screen means and support platform are removed from the apparatus by changing the screen, the screen means and support platform are essentially automatically separable.

BRIEF DESCRIPTION OF THE DRAWINGS

The foregoing summary, as well as the following detailed description of a preferred embodiment of the present invention, will be better understood when read in conjunction with the appended drawings, in which.

DESCRIPTION OF THE PREFERRED EMBODIMENT

Figure 1:
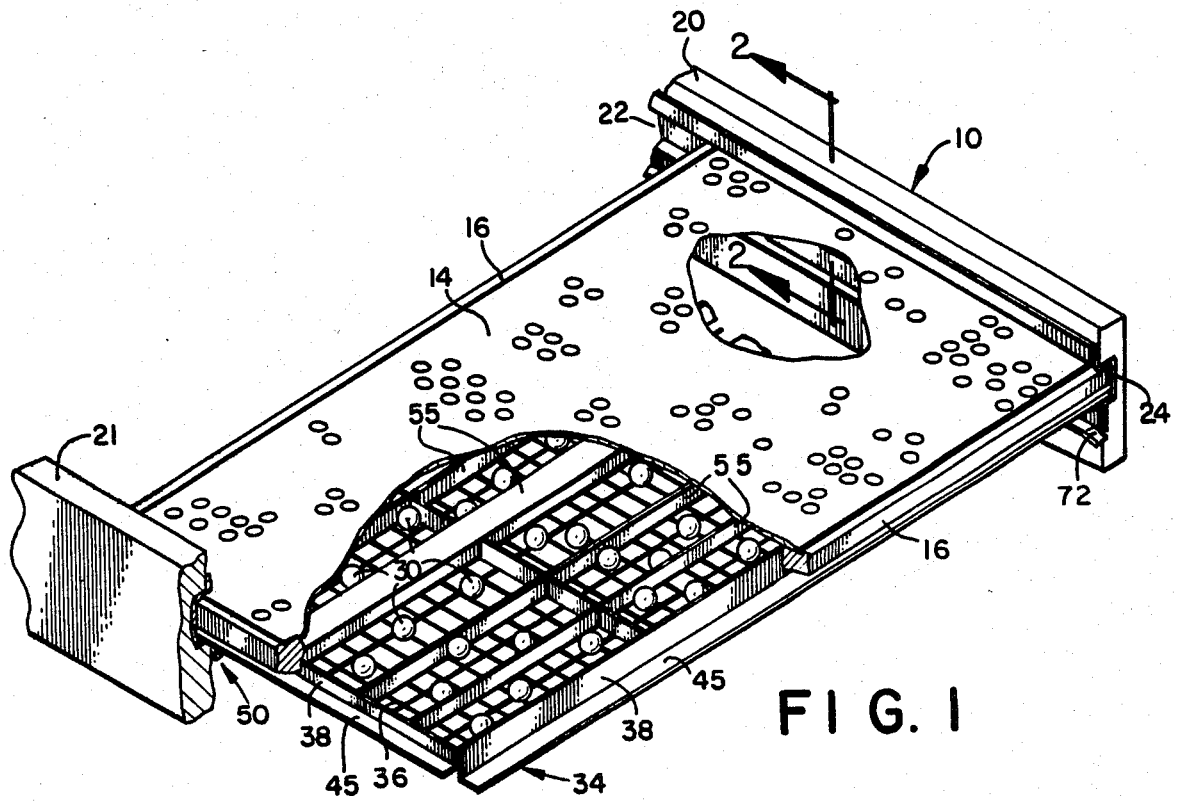
FIG. 1 is a perspective view, with parts broken away, of a screening assembly in accordance with the present invention for use in a screening apparatus for separating particulate materials.
Figure 3:
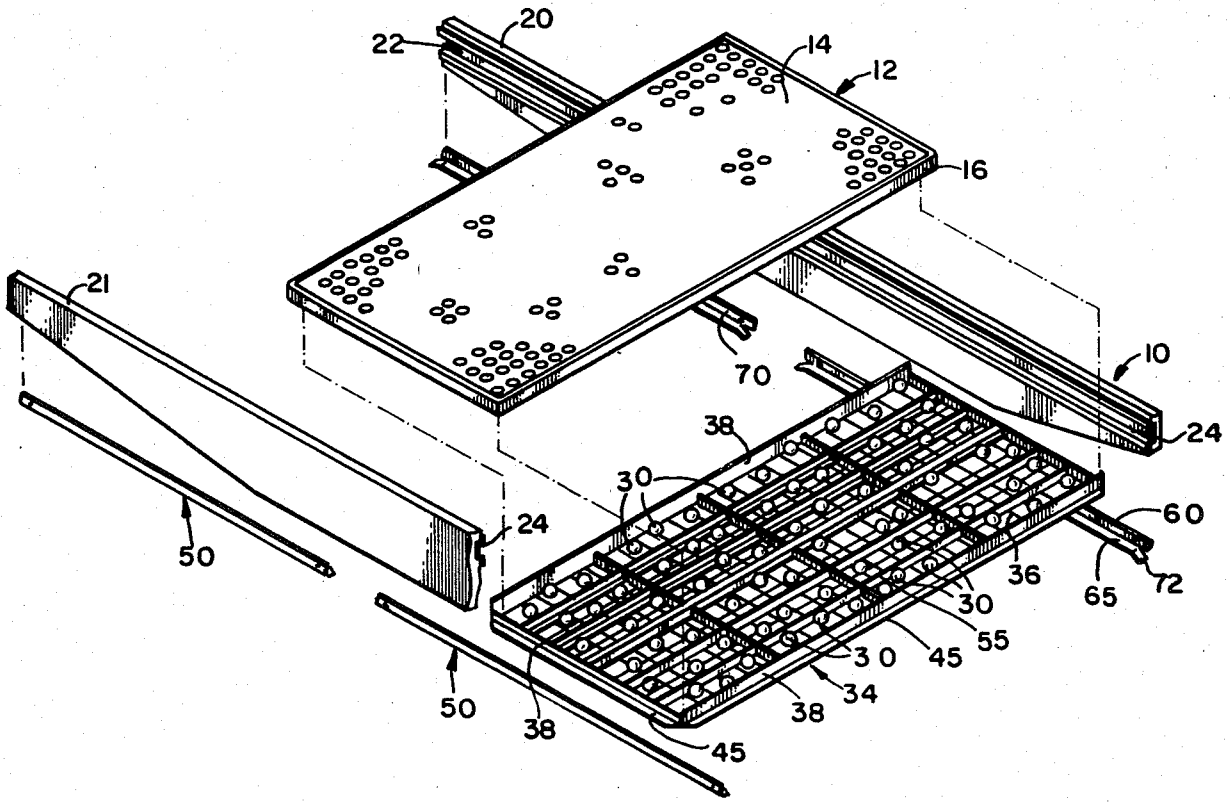
FIG. 3 is an exploded perspective view with parts broken away of the screening assembly illustrated in FIG. 1.

Referring to the drawings and initially to FIGS. 1 and 3, a screen assembly generally designated 10 is depicted for use in a screening apparatus for separating particulate material, such as commodity seed or other desired products susceptible to separation by screening, from particulate material of a smaller size, such as dirt, dust, weed seeds, and other debris. The screening assembly 10 includes screen means or screen element, generally designated 12, having a screen 14, typically in the form of perforated metal or wire mesh, mounted on a generally rectangular frame 16. The screen 14 has apertures of a selected size to permit the passage of fines, such as the undersized waste products, therethrough during the treatment of the particulate material.

Figure 2:
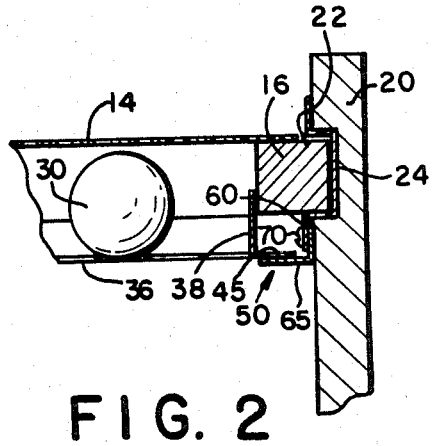
FIG. 2 is a fragmentary sectional view of the screening assembly taken along line 2—2 of FIG. 1.

The screen element 12 is removably mountable between a pair of driven agitator or rocker arms 20 and 21 of a screening apparatus (not shown). It is noted that the screening apparatus can be of any conventional type having a gyrating or vibrating action, for example, such as a "Clipper Cleaner" made by Ferrell-Ross Company of Saginaw, Mich. As shown in FIGS. 1 and 2, the screen element 12 is mounted on the pair of opposing rocker arms 20 and 21 at a slight inclination. For this purpose, the respective rocker arms each include a recessed generally linear guide channel 22, which extends along the length of each rocker arm, the channels 22 being in parallel relationship on the opposing rocker arms. The screen element is removably and slideably insertable into the respective guide channels, which function to receive and support the screen element on the respective rocker arms.

To prevent excessive wear, each of the guide channels 22 is lined with a metallic wear-resistant member 24 along the entire length of each channel. The wear-resistant members conform to the shape of the guide channels and are affixed to the rocker arms within the guide channels to provide a wear resistant lining.

To effect separation of the undesired waste material from the desired particular material, the particulate material is introduced onto one end, the upper end of the screen 14, that is, at the higher end of the inclined screen element 12. The rocker arms 20 and 21 are motor driven to vigorously agitate and vibrate the screen element. The particulate material introduced onto the screen 14 slowly migrates toward the lower end of screen 14 resulting in the smaller waste particles or fines being discharged through the apertures of the screen 14, while the overs, such as the desired particulate material, is retained on the screen and collected at the lower end for subsequent processing or removal.

To efficiently process various types and sizes of particulate material, interchangeable screen elements having screens with apertures of various selected sizes are necessary. With interchangeable screen elements, the screens can be efficiently matched to the type of particulate material being processed.

To prevent particulate material from clogging the screen apertures during processing, impact elements in the form of hard rubber balls 30, for example, are loosely supported underneath the screen 14 by a tray assembly or support platform generally designated 34. The tray assembly 34 is generally rectangular and includes a wire mesh base 36 mounted on a metallic frame structure to serves as the support for the rubber balls. The metallic frame structure includes opposed pairs of sidewalls 38 which function to retain the rubber balls on the wire mesh base 36.

The tray assembly 34, when assembled in the apparatus, is intermeshed with screen element 12 to form an enclosure for the rubber balls and to maintain the screen element and tray assembly in registry or operative relationship during the agitating operation of the rocker arms in the apparatus. The sidewalls 38 of the tray assembly are dimensioned and arranged to fit within, or intermesh with, the rectangular frame 16 of the screen element 12 forming the enclosure for the balls. When the screen element and tray assembly are intermeshed, the sidewalls 38 of the tray assembly project upwardly within the frame 16 of the screen element 12, as shown in FIG. 2, such that the screen element fits over the tray assembly to form, in effect, a lid. Generally outwardly extending planar projection members 45 are provided along each of the sidewalls 38 of the tray assembly.

The tray assembly is not attached to the screen element 12 but is independently supported by support members or guide rails 50, which are mountable on the respective rocker arms 20 and 21 generally underneath and parallel to the recessed guide channels 22. The projection elements 45 provided on opposite sides of the tray assembly are slideably engagable with guide rails 50 and permit the tray assembly to be slideably inserted and supported between the opposing rocker arms 20 and 21 generally underneath the screen element 12. In this arrangement of the screen element and tray assembly, when the parts are to be assembled within the apparatus, the tray assembly is intermeshed with the screen element forming the enclosure for the rubber balls, and the intermeshed structure is slideably inserted between the respective rocker arms 20 and 21 as a unit, as shown in FIG. 1. The screen element is solely and independently supported by the recessed guide channels 22 provided on the respective rocker arms while the tray assembly is independently supported by support rails 50. The intermeshed arrangement, but independent suspension, of the screen element and the tray assembly between the rocker arms eliminates the need for fasteners to interconnect and fasten the screen element with the tray assembly and facilitates automatic separation of the screen element and tray assembly upon removal from the apparatus.

The guide rails 50 are in the form of angle rails having a generally planar sidewall 60 mounted on the inner surface of the respective rocker arms and an integral generally perpendicular planar support ledge 65, which projects outwardly from the rocker arm to be generally beneath and parallel to the respective guide channels 22. As best illustrated in FIG. 2, to mount the support rail on the rocker arms in proper position or relationship, the top portion of the support wall 60 is snuggly inserted between a lower section of the wear resistant member 24 in the recessed guide channel 22. Once in position, the support rail can be securely fastened to the rocker arm by conventional fastening means, such as screws 70, so that support ledge 65 is aligned and suspended beneath and parallel with the recessed guide channels 22 on the respective rocker arms. If the conventional screening apparatus includes a conventional brush-type screen cleaner, the tray assembly, in accordance with the present invention, can be easily retrofitted into such an apparatus by simply installing the guide rail rails 50 into the respective screen guide channels 24 of the rocker arms 20 and 21, respectively, after the brush-type screen cleaner is removed.

In order for the ball tray assembly to be easily guided onto the guide rails 50, an access guide or alignment element 72 is provided on each rail 50 to guide the tray assembly onto the generally planar surface of the support ledge 65 at the leading edge or mouth of the support rails 50. The alignment elements 72 are formed by having the leading end of support ledge 65 bent slightly downward relative to the support plane to form the access alignment element.

Since the screen element and the tray assembly are mounted on the rocker arms at a slight inclination, a grid of divider walls 55 is provided on the base of the tray assembly to divide the tray assembly into a series of separate individual rectangular compartments for enclosing the balls. A selected number of rubber balls, such as three, are contained within each individual compartment. The divider walls function to retain the rubber balls in designated areas underneath the surface of the screen 14 preventing the balls from leaving a designated area of the inclined tray assembly.

In processing the particulate material in the apparatus, the rocker arms vigorously vibrate or oscillate the screen element simultaneously with the tray assembly as a unit. The particulate material is introduced onto the end of the inclined screen 14. As the particulate material migrates down the incline of the screen, the smaller particulate material passes through the apertures of the screen element 14 and through the wire mesh base 36 of the tray assembly. To permit easy passage of the smaller separated particulate material through the tray assembly, the apertures of the wire mesh base 36 are much larger in cross-section than the apertures provided in screen 14. As the rocker arms vibrate the screen 14, the rubber balls supported on the underlying tray assembly impact the under surface of the screen to dislodge particulate material which becomes trapped or lodged in the apertures of the screen.

As previously mentioned, the support rails 50 function to independently support the tray assembly generally underneath the screen element 14, while the sidewalls 38 of the tray assembly extend upwardly within the frame 16 of the screen element 12 to maintain the tray assembly in registry with the screen element 12, preventing any lateral movement between the screen element and the tray assembly during the vigorous vibration of the rocker arms. Conventional stop elements, such as retaining clips or the apparatus housing (not illustrated), are provided in cooperation with the guide channels 22 at their respective ends to prevent the screen elements from inadvertently sliding out of the ends of the guide channels.

Since different screens having different sized apertures are required for screening different sized particulate material, for efficient and rapid changing of the screens in the apparatus, it is desired that the tray assembly not be attached or affixed to the screen element 12, but be independently supported generally underneath the screen element, as previously described. To change screens, the intermeshed unit of the screen element and tray assembly may easily be removed from the screening apparatus by sliding the unit out of the guides on the rocker arms. Once removed, the screen element is lifted from the tray assembly and another screen element is then placed into intermeshed position with the tray assembly. The new unit is then slideably inserted within the respective support guides provided on the opposing rocker arms. In this arrangement, the new screen element is independently supported on the opposing guide channels 24 in an intermeshed but unattached relationship with the tray assembly supported on guide rails 50.

While a certain preferred embodiment of the present invention has been illustrated and described, the present invention may be variously embodied within the scope of the following claims.

What is claimed is:

1. In an apparatus for separating particulate material of a selected size from particulate material of a smaller size, a screening assembly comprising:

(a) screen means having apertures of a selected size for receiving and separating the particulate material;

(b) impact elements for impacting the screen means to dislodge particulate material from the apertures;

(c) a support tray means adapted to underlie said screen means and having upwardly-projecting wall means to intermesh with the screen means to form an enclosure between said tray means and the screen means for said impact elements, said support tray means loosely supporting said impact elements in said enclosure;

(d) agitator means for agitating the enclosure to impact the screen means with the impact elements and to convey said particulate material along said screen means to separate the particulate material of the smaller size through the apertures;

(e) first guide means on the agitator means for receiving and supporting the screen means independently of the intermeshing support tray means; and (f) second guide means on the agitator means for receiving and supporting the support tray means in said underlying relation to position said wall means in said intermeshing relationship with the screen means to form the enclosure, the second guide means being adapted to support the support tray means of the enclosure independently of the screen means of the enclosure so that the intermeshed screen means and support tray means are each independently supported, said first and second guide means adapted to permit sliding movement of said intermeshed screen means and tray means out of said intermeshing relationship so as to be freely separable.

2. The apparatus as recited in claim 1 wherein the second guide means includes a pair of opposing support rails and the support tray means includes slide means for slideably engaging the support rails to support the support tray means on the support rails.

3. The apparatus as recited in claim 2 including means for mounting the support rails on the agitator means.

4. The apparatus as recited in claim 2 wherein the agitator means includes a pair of rocker arms and means mounting each support rail on a respective rocker arm.

5. The apparatus as set forth in claim 2 wherein each support rail includes a sidewall engaged with said agitator means and a generally perpendicular support ledge integral with the sidewall for supporting the support tray means.

6. The apparatus as set forth in claim 5 wherein the support rail includes an access guide element connected with the support ledge for receiving and guiding the support tray means onto the support ledge of the support rail.

7. The apparatus as set forth in claim 1 wherein the screen means includes a frame, and said wall means of the support tray means includes at least one intermeshing insertion member for removable engagement within the frame to intermesh the screen means and support tray means, thereby retaining the support tray means in registry with the screen means and preventing relative lateral movement while the apparatus is in operation.

8. The apparatus as set forth in claim 7 wherein the second guide means includes a pair of opposing support rails and the support tray means includes slide means for slideably engaging the support rails to support the support tray means on the support rails and wherein the first guide means includes a guide channel and the frame is slideably insertable into the guide channel.

9. The apparatus as set forth in claim 1 wherein the support tray means includes retaining walls for retaining the impact elements on the support tray means and divider means for dividing the support tray means into a plurality of compartments for respectively retaining different ones of the impact elements therein.

10. In an apparatus for separating particulate material of a selected size from particulate material of a smaller size provided with screen means with apertures of a selected size for separating the particulate material, agitator means for agitating the particulate material along the screen means, the agitator means having first guide means for receiving the screen means for agitating the screen means, and a screen cleaning assembly, the screen cleaning assembly comprising:

(a) impact elements for impacting the screen means to dislodge particulate material from the apertures;

(b) a support tray means adapted to intermesh with the screen means for loosely supporting said impact elements in close relationship with the screen means and to form an enclosure between the tray means and the screen means for the impact elements; and (c) second guide means supported by the agitator means receiving and supporting the support tray means and retaining the support tray means with the screen means to form the enclosure, so that the intermeshed support tray means and screen means are each independently supported, said first and second guide means adapted to permit sliding movement of said intermeshed tray means and screen means out of intermeshing relationship so as to be separable upon removal from the first and second guide means.

11. The apparatus as recited in claim 10 wherein the second guide means includes a pair of opposing support rails and the support tray means includes slide means for slideably engaging the support rails to support the support tray means by the support rails.

12. The apparatus as recited in claim 11 wherein said first guide means comprise elongated guide channels in said agitator means and including means for mounting the support rails on the agitator means parallel to said guide channels.

13. The apparatus as recited in claim 11 wherein the agitator means comprises a pair of rocker arms interconnected to be driven together to agitate and vibrate the screen means, and means mounting each support rail on a respective one of said rocker arms.

14. The apparatus as set forth in claim 11 wherein each support rail includes a sidewall engaged with said agitator means and a generally perpendicular support ledge integral with the sidewall for supporting the support tray means.

15. The apparatus as set forth in claim 14 wherein the support rail includes an access guide element connected with the support ledge for receiving and guiding the support tray means onto the support ledge of the support rail.

16. The apparatus as set forth in claim 10 wherein the screen means includes a frame and the support tray means includes at least one intermeshing insertion member for removable insertion within the frame to intermesh the screen means and support tray means to retain the support tray means in registry with the screen means on the respective guide means while the apparatus is in operation.

17. The apparatus as set forth in claim 16 wherein the second guide means includes a pair of opposing support rails and the support tray means includes slide means for slideably engaging the support rails to support the support tray means on the support rails and wherein the first guide means includes a guide channel and the frame is slideably insertable into the guide channel.

18. The apparatus as set forth in claim 11 wherein the support tray means includes retaining walls for retaining the impact elements on the support tray means and divider means for dividing the support tray means into a plurality of compartments for respectively retaining different ones of the impact elements therein.

* * * * *